US012474114B2

(12) United States Patent
Roberts et al.

(10) Patent No.: US 12,474,114 B2
(45) Date of Patent: Nov. 18, 2025

(54) SEMI-OPEN LOOP LIQUEFACTION PROCESS

(71) Applicant: Honeywell LNG LLC, Wilmington, DE (US)

(72) Inventors: Mark Julian Roberts, Whitehall, PA (US); Russell B. Shnitser, Coopersburg, PA (US)

(73) Assignee: HONEYWELL LNG LLC, Wilmington, DE (US)

( * ) Notice: Subject to any disclaimer, the term of this patent is extended or adjusted under 35 U.S.C. 154(b) by 442 days.

(21) Appl. No.: 17/965,865

(22) Filed: Oct. 14, 2022

(65) Prior Publication Data

US 2024/0125544 A1 Apr. 18, 2024

(51) Int. Cl.
*F25J 1/00* (2006.01)

(52) U.S. Cl.
CPC ..... *F25J 1/004* (2013.01); *F25J 1/0025* (2013.01); *F25J 1/0035* (2013.01); *F25J 1/0082* (2013.01); *F25J 2270/06* (2013.01); *F25J 2270/08* (2013.01)

(58) Field of Classification Search
CPC ..... F25J 1/0201; F25J 1/0219; F25J 1/0208; F25J 1/004; F25J 2270/08
See application file for complete search history.

(56) References Cited

U.S. PATENT DOCUMENTS 4,012,212 A 3/1977 Kniel
4,541,852 A 9/1985 Newton et al.
6,308,531 B1 10/2001 Roberts et al.
9,651,300 B2 5/2017 Eaton
2004/0255616 A1* 12/2004 Maunder ..... F25J 1/0022 62/611
2005/0279133 A1 12/2005 Eaton
(Continued)

FOREIGN PATENT DOCUMENTS

CN 105823304 8/2016
GB 2522421 7/2015
(Continued)

OTHER PUBLICATIONS

R. P. Saunderson, "Finding the Right Combination of LNG Subcooling and End-Flash", LNG Industry, Jun. 30, 2021.
(Continued)

*Primary Examiner* — Brian M King
(74) *Attorney, Agent, or Firm* — CANTOR COLBURN LLP

(57) ABSTRACT

Described herein are methods and systems for liquefying natural gas by: cooling and liquefying a natural gas feed stream via indirect heat exchange with at least a first cold refrigerant stream to form a first liquefied natural gas stream and a warmed gaseous refrigerant stream; flashing and separating the first liquefied natural gas stream to form a liquefied natural gas product stream and at least a first flash gas stream; combining and compressing the first flash gas stream and the warmed gaseous refrigerant stream to form a compressed refrigerant stream; and expanding at least a first portion of the compressed refrigerant stream to form the first cold refrigerant stream; wherein the natural gas feed stream is kept separate from and is not combined with either the first flash gas stream or the compressed refrigerant stream.

19 Claims, 3 Drawing Sheets

(56) References Cited

U.S. PATENT DOCUMENTS

| | | | | |
|---|---|---|---|---|
| 2016/0313057 | A1* | 10/2016 | Roberts | F25J 1/0278 |
| 2017/0227283 | A1 | 8/2017 | Kennedy et al. | |
| 2018/0018035 | A1 | 1/2018 | Kurokawa et al. | |
| 2019/0346203 | A1 | 11/2019 | Chen et al. | |
| 2019/0346206 | A1* | 11/2019 | Kim | F27D 19/00 |

FOREIGN PATENT DOCUMENTS

| | | | |
|---|---|---|---|
| JP | S60191175 | A | 9/1985 |
| JP | 2001165562 | A | 6/2001 |
| WO | 2022106260 | | 5/2022 |

OTHER PUBLICATIONS

Japanese OA for application JP 2024-058649, translation, Issued Dec. 3, 2024, Received Mar. 3, 2025, 4 pages.

Mark J. Roberts, et al, "Innovative Liquefaction Technology for Floating LNG", 2017 Gastech Conference and Exhibition—Part of the Floating LNG: Design and Technology Session, Tokyo, Japan, Apr. 6, 2017, 1-10.

Mark J. Roberts, et al, "An Evolutionary Approach", Hydrocarbon Engineering, Feb. 2019, 1-4.

* cited by examiner

SEMI-OPEN LOOP LIQUEFACTION PROCESS

BACKGROUND

The present invention relates to a method and system for liquefying natural gas, in which a natural gas feed stream is cooled and liquefied via indirect heat exchange with one or more streams of refrigerant and the resulting liquefied natural gas (LNG) stream is then flashed and separated to produce an LNG product.

A variety of methods and systems for liquefying natural gas are known in the art, a number of which are described in the article "An Evolutionary Approach", Hydrocarbon Engineering, February 2019, by Roberts, Bukowski and Mitchell. FIG. 5 of this article shows the AP-C1™ liquefaction process developed by Air Products, which is also described in a paper titled "Innovative Liquefaction Technology for Floating LNG" by Mark J. Roberts, Dr. Öznur Saygi-Arslan, Dr. Fei Chen and Janet F. Mitchell that is associated with a presentation on Apr. 6, 2017 at 9:40-10:05 AM, as part of the Floating LNG: Design and Technology Session at the 2017 Gastech Conference & Exhibition in Tokyo, Japan.

Air Products developed the AP-C1™ liquefaction process to take advantage of benefits of methane as a Brayton refrigeration cycle working fluid. In the AP-C1™ process, a natural gas feed stream is liquefied, via indirect heat exchange with a methane-based refrigerant circulating in a closed loop reverse-Brayton refrigeration cycle, before being flashed to produce the final LNG product.

US patent application US 2018/0180354 A1 depicts a method of liquefying a natural gas feed stream using an open-loop cycle. In this method, the compressed refrigerant stream exiting the refrigerant compressor is split into first and second portions, with the first portion being combined with the natural gas feed stream before the natural gas feed stream is expanded in an expander and separated in a separator into vapor and liquid fractions, with the vapor fraction being warmed in a first heat exchanger before being routed to the refrigerant compressor. The second portion of the refrigerant stream is cooled in the first heat exchanger section before being further split into third and fourth portions, with the third portion being further cooled and liquefied in a second heat exchanger to provide the LNG product, and with the fourth portion being expanded in an expander and separated in a separator into vapor and liquid fractions, with the vapor fraction being warmed in the second heat exchanger and further warmed in the first heat exchanger before being routed to the refrigerant compressor.

BRIEF SUMMARY

Disclosed herein are methods and systems (also referred to herein as "semi-open loop" methods and systems) for liquefying natural gas, in which a natural gas feed stream is cooled and liquefied via indirect heat exchange with one or more streams of cold refrigerant and the resulting LNG stream is then flashed and separated to produce a flash gas and an LNG product. In the disclosed methods and systems (which methods and systems are also referred to herein as "semi-open loop" methods and systems) the flash gas and the warmed gaseous refrigerant are combined and compressed to form a compressed refrigerant that provides the refrigerant that is then expanded to provide the one or more streams of cold refrigerant, with the natural gas feed stream being kept separate from both the flash gas and the compressed refrigerant.

Several preferred aspects of the methods and systems according to the present invention are outlined below.

Aspect 1: A method of liquefying natural gas, the method comprising the steps of:

(a) cooling and liquefying a natural gas feed stream via indirect heat exchange with at least a first cold refrigerant stream to form a first liquefied natural gas stream and a warmed gaseous refrigerant stream;

(b) flashing and separating the first liquefied natural gas stream to form a liquefied natural gas product stream and at least a first flash gas stream;

(c) combining and compressing the first flash gas stream and the warmed gaseous refrigerant stream to form a compressed refrigerant stream; and (d) expanding at least a first portion of the compressed refrigerant stream to form the first cold refrigerant stream;

wherein the natural gas feed stream is kept separate from and is not combined with either the first flash gas stream or the compressed refrigerant stream.

Aspect 2: A method according to Aspect 1, wherein step (a) takes place in one or more coil-wound heat exchanger sections of a main coil-wound heat exchanger unit or set of units.

Aspect 3: A method according to Aspect 1 or 2, wherein step (c) comprises compressing the first flash gas stream in one or more flash gas compression stages prior to combining the first flash gas stream and the warmed gaseous refrigerant stream and compressing said combined first flash gas stream and warmed gaseous refrigerant stream in one or more refrigerant compression stages to form the compressed refrigerant stream.

Aspect 4: A method according to any one of Aspects 1 to 3, wherein the method further comprises the steps of:

(e) withdrawing a first auxiliary stream of natural gas from the natural gas feed stream prior to the natural gas feed stream being cooled and liquefied in step (a); and (f) cooling and liquefying the first auxiliary natural gas stream via indirect heat exchange with the first flash gas stream to form a second liquefied natural gas stream;

wherein the first flash gas stream is warmed in step (f) before being compressed and combined with the warmed gaseous refrigerant stream in step (c), and wherein step (b) comprises combining, flashing and separating the second liquefied natural gas stream and the first liquefied natural gas stream to form the liquefied natural gas product stream and at least the first flash gas stream.

Aspect 5: A method according to Aspect 4, wherein step (f) takes place in one or more coil-wound heat exchanger sections of a first flash gas heat exchanger unit or set of units.

Aspect 6: A method according to Aspect 5, wherein the first flash gas heat exchanger unit is an integrated heat exchanger and phase separator comprising a shell casing containing one or more coil-wound heat exchanger sections located above a phase separator section, and wherein said phase separator section is used in step (b) to separate the first flash gas stream from the first and second liquefied natural gas streams.

Aspect 7: A method according to any one of Aspects 4 to 6, wherein step (f) comprises precooling, cooling and liquefying the first auxiliary natural gas stream via indirect heat exchange with the first flash gas stream to form a second liquefied natural gas stream, and wherein the method further comprises withdrawing a first side-stream of natural gas from the first auxiliary natural gas stream after precooling and prior to liquefaction of the first auxiliary natural gas stream, and introducing the first side-stream of natural gas into the natural gas feed stream after precooling of the natural gas feed stream and prior to liquefaction of the natural gas feed stream in step (a).

Aspect 8: A method according to any one of Aspects 1 to 7, wherein step (b) comprises flashing and separating the first liquefied natural gas stream to form the liquefied natural gas product stream and at least the first flash gas stream and a second flash gas stream, wherein step (c) comprises combining and compressing the second flash gas stream, the first flash gas stream and the warmed gaseous refrigerant stream to form a compressed refrigerant stream, and wherein the natural gas feed stream is also kept separate from and is not combined with the second flash gas stream.

Aspect 9: A method according to Aspect 8, wherein step (c) comprises compressing the second flash gas stream in one or more flash gas compression stages prior to combining the second flash gas stream and the first flash gas stream and then compressing the combined first and second flash gas streams in one or more further flash gas compression stages prior to combining the combined first and second flash gas streams and the warmed gaseous refrigerant stream and compressing the combined first and second flash gas streams and the warmed gaseous refrigerant stream in one or more refrigerant compression stages to form the compressed refrigerant stream.

Aspect 10: A method according to Aspect 8 or 9, wherein the method further comprises the steps of:

(e) withdrawing a first auxiliary stream of natural gas and a second auxiliary stream of natural gas from the natural gas feed stream prior to the natural gas feed stream being cooled and liquefied in step (a);

(f) cooling and liquefying the first auxiliary natural gas stream via indirect heat exchange with the first flash gas stream to form a second liquefied natural gas stream; and (g) cooling and liquefying the second auxiliary natural gas stream via indirect heat exchange with the second flash gas stream to form a third liquefied natural gas stream wherein the first flash gas stream is warmed in step (f) before being compressed and combined with the second flash gas stream and warmed gaseous refrigerant stream in step (c), wherein the second flash gas stream is warmed in step (g) before being compressed and combined with the first flash gas stream and warmed gaseous refrigerant stream in step (c), and wherein step (b) comprises combining, flashing and separating the second liquefied natural gas stream and the first liquefied natural gas stream to form a fourth liquefied natural gas stream and the first flash gas stream, and then combining, flashing and separating the fourth liquefied natural gas stream and the third liquefied natural gas stream to form the liquefied natural gas product stream and at least the second flash gas stream.

Aspect 11: A method according to Aspect 10, wherein step (f) takes place in one or more coil-wound heat exchanger sections of a first flash gas heat exchanger unit or set of units, and step (g) takes place in one or more coil-wound heat exchanger sections of a second flash gas heat exchanger unit or set of units.

Aspect 12: A method according to Aspect 11, wherein the first flash gas heat exchanger unit is an integrated heat exchanger and phase separator comprising a shell casing containing one or more coil-wound heat exchanger sections located above a phase separator section, wherein said phase separator section is used in step (b) to separate the first flash gas stream from the first and second liquefied natural gas streams, and wherein the second flash gas heat exchanger unit is an integrated heat exchanger and phase separator comprising a shell casing containing one or more coil-wound heat exchanger sections located above a phase separator section, wherein said phase separator section is used in step (b) to separate the second flash gas stream from the third and fourth liquefied natural gas stream.

Aspect 13: A method according to any one of Aspects 10 to 12, wherein step (f) comprises precooling, cooling and liquefying the first auxiliary natural gas stream via indirect heat exchange with the first flash gas stream to form a second liquefied natural gas stream, wherein step (g) comprises precooling, cooling and liquefying the second auxiliary natural gas stream via indirect heat exchange with the second flash gas stream to form a third liquefied natural gas stream, and wherein the method further comprises withdrawing a first side-stream of natural gas from the first auxiliary natural gas stream after precooling and prior to liquefaction of the first auxiliary natural gas stream, withdrawing a second side-stream of natural gas from the second auxiliary natural gas stream after precooling and prior to liquefaction of the second auxiliary natural gas stream, and introducing the first side-stream of natural gas and the second side-stream of natural gas into the natural gas feed stream after precooling of the natural gas feed stream and prior to liquefaction of the natural gas feed stream in step (a).

Aspect 14: A method according to any one of Aspects 1 to 13, wherein the method further comprises the steps of:

(h) introducing the liquefied natural gas product stream into and storing the liquefied natural gas product in a liquefied natural gas storage tank; and (i) withdrawing a boil-off gas stream from the liquefied natural gas storage tank;

wherein step (c) comprises combining and compressing the boil-off gas stream, the first flash gas stream and the warmed gaseous refrigerant stream to form the compressed refrigerant stream, and wherein the natural gas feed stream is also kept separate from and is not combined with the boil-off gas stream.

Aspect 15: A method according to Aspect 14, wherein step (c) comprises compressing the boil-off gas stream in one or more boil-off gas compression stages prior to combining the boil-off gas stream, the first flash gas stream and the warmed gaseous refrigerant stream and compressing said combined boil-off gas stream, first flash gas stream and warmed gaseous refrigerant stream in one or more refrigerant compression stages to form the compressed refrigerant stream.

Aspect 16: A method according to any one of Aspects 1 to 15, wherein step (d) comprises expanding a first portion of the compressed refrigerant stream to form the first cold refrigerant stream, wherein step (b) comprises combining, flashing and separating the first liquefied natural gas stream and a second cold refrigerant stream to form the liquefied natural gas product stream and at least the first flash gas stream, and wherein the method further comprises the step of:

(j) cooling a second portion of the compressed refrigerant stream, via indirect heat exchange with the first cold refrigerant stream, to form the second cold refrigerant stream.

Aspect 17: A method according to Aspect 16, wherein the method further comprises the step of:

(k) expanding a third portion of the compressed refrigerant stream to form a third cold refrigerant stream; and wherein step (a) comprises precooling the natural gas feed stream via indirect heat exchange with the first and third cold refrigerant streams and further cooling and liquefying a natural gas feed stream via indirect heat exchange with the first cold refrigerant stream to form the first liquefied natural gas stream from the natural gas feed stream and the warmed gaseous refrigerant stream from the first and third cold refrigerant streams.

Aspect 18: A method according to Aspect 17, wherein the method further comprises the step of:

(l) precooling the first and second portions of the compressed refrigerant stream via indirect heat exchange with the first and third cold refrigerant streams prior to the first portion of the compressed refrigerant stream being expanded in step (d) and prior to the second portion of the compressed refrigerant being stream being further cooled in step (j).

Aspect 19: A method according to Aspect 17 or 18, wherein the third cold refrigerant stream is gaseous refrigerant stream.

Aspect 20: A method according to any one of Aspects 1 to 19, wherein the first cold refrigerant stream is a gaseous refrigerant stream Aspect 21: A method according to any one of Aspects 1 to 20, wherein the natural gas feed stream is cooled in step (a) to form a first liquefied natural gas stream at a temperature of between 90° C. and 115° C.

Aspect 22: A system for liquefying natural gas, the system comprising:

one or more heat exchanger sections arranged and configured to receive a natural gas fee stream and at least a first cold refrigerant steam and to cool and liquefy the natural gas feed stream via indirect heat exchange with at least the first cold refrigerant stream to form a first liquefied natural gas stream and a warmed gaseous refrigerant stream;

one or more expansion and separation devices arranged and configured to receive, flash and separate the first liquefied natural gas stream to form a liquefied natural gas product stream and at least a first flash gas stream;

one or more conduits and refrigerant compression stages arranged and configured to receive, combine and compress the first flash gas stream and the warmed gaseous refrigerant stream to form a compressed refrigerant stream; and an expansion device arranged and configured to receive and expand at least a first portion of the compressed refrigerant stream to form the first cold refrigerant stream;

wherein the system is arranged and configured such that the natural gas feed stream is kept separate from and is not combined with either the first flash gas stream or the compressed refrigerant stream.

DETAILED DESCRIPTION

Figure 1:
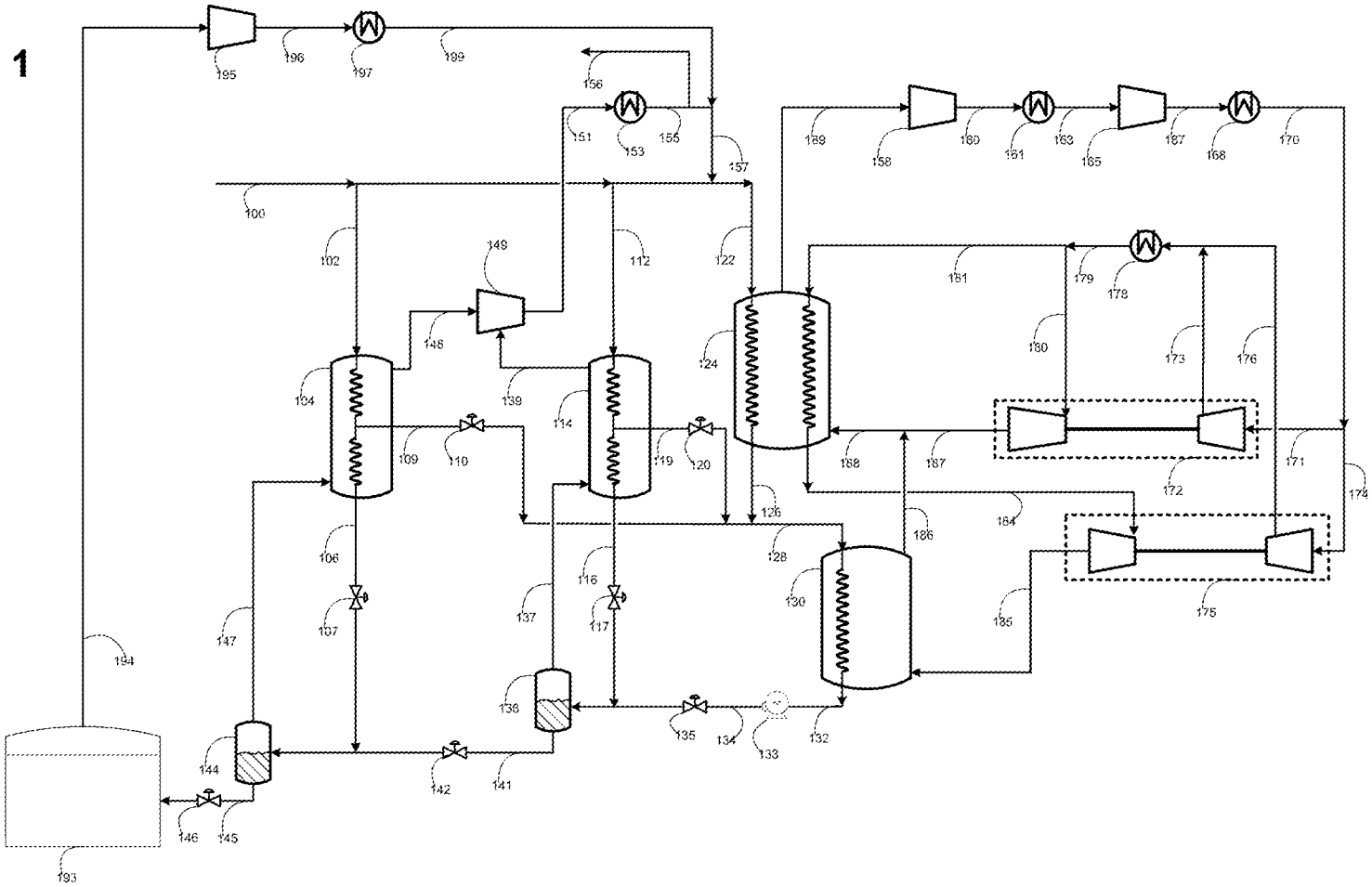
FIG. 1 is a schematic flow diagram depicting a comparative method and system for cooling and liquefying natural gas, not in accordance with the present invention.

Described herein are methods and systems for liquefying natural gas, in which a natural gas feed stream is cooled and liquefied via indirect heat exchange with one or more streams of refrigerant and the resulting LNG stream is then flashed and separated to produce an LNG product.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question and are not intended to indicate any specific order of the features, unless and only to the extent that such order is specifically recited.

As used herein, the term "natural gas" encompasses also synthetic and/or substitute natural gases. The major component of natural gas is methane (which typically comprises at least 85 mole %, more often at least 90 mole %, and on average about 95 mole % of the feed stream). Other typical components of raw natural gas that may be present in smaller amounts include one or more "light components" (i.e. components having a lower boiling point than methane) such as nitrogen, helium, and hydrogen, and/or one or more "heavy components" (i.e. components having a higher boiling point than methane) such as carbon dioxide and other acid gases, moisture, mercury, and heavier hydrocarbons such as ethane, propane, butanes, pentanes, etc. However, prior to being liquefied the raw natural gas feed stream will be treated if and as necessary in order to reduce the levels of any heavy components that may be present down to such levels as are needed to avoid freezing or other operational problems in the heat exchanger section or sections in which the natural gas is to be cooled and liquefied.

As used herein, the term "liquefied natural gas" refers to natural gas that is in the liquid phase or, in relation to natural gas that is at a temperature and pressure above its critical point (i.e. that is a supercritical fluid), to natural gas that is at a density greater than its critical point density. Likewise, references to "liquefying" a natural gas refer to the conversion (typically by cooling) of a natural gas from vapor to liquid (i.e. from the gaseous to liquid phase) or, in relation to natural gas that is at a temperature and pressure above its critical point, to the act of increasing (typically by cooling) the density of the natural gas to a density greater than its critical point density.

As used herein, the term "indirect heat exchange" refers to heat exchange between two fluids where the two fluids are kept separate from each other by some form of physical barrier.

As used herein, the term "heat exchanger section" refers to a unit or a part of a unit in which indirect heat exchange is taking place between one or more streams of fluid flowing through the cold side of the heat exchanger section and one or more streams of fluid flowing through the warm side of the heat exchanger section, the stream(s) of fluid flowing through the cold side being thereby warmed, and the stream(s) of fluid flowing the warm side being thereby cooled (the terms "warm side" and "cold side" being purely relative). Unless otherwise indicated, a heat exchanger section may a heat exchanger section of any suitable type, such as but not limited to a heat exchanger section of a shell and tube, coil wound, or plate and fin type of heat exchanger.

As used herein, the terms "coil wound heat exchanger" and "coil wound heat exchanger unit" refer to a heat exchanger of the type known in the art, comprising one or more tube bundles encased in a shell casing. A "coil wound heat exchanger section" comprises one or more of said tube bundles, the "tube side" of said bundle(s), i.e. the interior of the tubes in the bundle(s), typically representing the warm side of said section and defining one or more passages (also referred to as tube circuits) through the section, and the "shell side" of said bundle(s), i.e. the space between and defined by the interior of the shell casing and exterior of the tubes, typically representing the cold side of said section and defining a single passage through the section. The shell side is almost always used as the cold side of the section, with the refrigerant providing cooling duty to the section being therefore passed through the shell side, because the shell side provides much lower flow resistance and allows for a much greater pressure drop than the tube side which makes passing expanded streams of cold refrigerant through the shell side much more effective and efficient. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section it is not possible use more than one stream of refrigerant in the shell side of the coil wound heat exchanger section without said streams of refrigerant mixing in the shell side of said heat exchanger section.

As used herein, the term "flashing" (also referred to in the art as "flash evaporating") refers to the process of reducing the pressure of a liquid (or supercritical or two-phase) stream so as to cool the stream and vaporize some of the liquid resulting in a colder, lower pressure two-phase mixture of vapor and liquid, the vapor present in this mixture also being referred to as the "flash gas". As use herein, the phrase "flashing and separating" refers to the process of flashing a stream and separating the flash gas from the remaining liquid.

As used herein, the phrases "gaseous stream of refrigerant" and "gaseous refrigerant stream" refer to a stream of refrigerant where substantially all, and more preferably all of the stream is vapor (i.e. is in the gaseous phase) Preferably the stream is at least 80 mole % vapor (i.e. has a vapor fraction of at least 0.8), and more preferably the stream is at least 90 mole %, at least 95 mole %, or at least 99 mole % vapor.

As used herein, the term "expansion device" refers to any device or collection of devices suitable for expanding and thereby lowering the pressure of a fluid. Suitable types of expansion device for expanding a fluid include "isentropic" expansion devices, such as expanders (i.e. turbo-expanders or hydraulic turbines), in which the fluid is expanded and the pressure and temperature of the fluid thereby lowered in a substantially isentropic manner (i.e. in a manner that generates works); and "isenthalpic" expansion devices, such as valves or other throttling devices, in which the fluid is expanded and the pressure and temperature of the fluid thereby lowered without the generating work.

As used herein, the term "separation device" refers to any device or collection of devices suitable for separating a two-phase (vapor and liquid) stream or mixture into separate vapor (gas) and liquid streams. Exemplary of separation devices include phase separators and distillation columns. The term "distillation column" refers to a column containing one or more separation stages, composed of devices such as packing or trays, that increase contact and thus enhance mass transfer between upward rising vapor and downward flowing liquid inside the column such that liquid and vapor streams exiting the column are not in equilibrium (the concentration of higher volatility components being increased in the upward rising vapor and the concentration of lower volatility components being increased in the downward flowing liquid). The term "phase separator" refers to a drum or other form of vessel in which a two-phase stream can separate into its constituent vapor and liquid phases where the liquid and vapor streams exiting the vessel are in equilibrium (there being no separation stages inside a phase separator).

Solely by way of example, exemplary embodiments of the invention will now be described with reference to the Figures. In the Figures, where a feature is common to more than one Figure that feature has been assigned the same reference numeral. Unless a feature is specifically described as being different from other embodiments in which it is shown in the drawings, that feature can be assumed to have the same structure and function as the corresponding feature in the embodiment in which it is described. Moreover, if that feature does not have a different structure or function in a subsequently described embodiment, it may not be specifically referred to in the specification.

Referring to FIG. 1, a comparative method and system for liquefying natural gas, not in accordance with the present invention, is shown. The method and system shown in FIG. 1 is similar to the AP-C1™ method and system described in the paper "Innovative Liquefaction Technology for Floating LNG" by Roberts et. al. associated with the 2017 Gastech Conference & Exhibition, and in the article "An Evolutionary Approach" by Roberts et. al. in Hydrocarbon Engineering, February 2019.

A natural gas feed stream 100, 122 is routed to a main heat exchanger comprising a precooling heat exchanger section 124 and a liquefaction heat exchanger section 130. Two auxiliary streams of natural gas 102, 112 are withdrawn from the natural gas feed stream 100 before the natural gas feed stream 122 is introduced into the main heat exchanger. The natural gas feed stream 122 is precooled in the precooling heat exchanger section 124, and the resulting precooled natural gas feed stream 126, 128 is then further cooled and liquefied in the liquefaction heat exchanger section 130 to form a first LNG stream 132.

The first auxiliary natural gas stream 112 is routed to a first flash gas heat exchanger 114 comprising a precooling heat exchanger section and a liquefaction heat exchanger section. The first auxiliary natural gas stream 112 is precooled in the precooling heat exchanger section of the first flash gas heat exchanger 114 to form a precooled first auxiliary natural gas stream, and the precooled first auxiliary natural gas stream is then further cooled and liquefied in the liquefaction heat exchanger section of the first flash gas heat exchanger 114 to form a second LNG stream 116.

The second auxiliary natural gas stream 102 is routed to a second flash gas heat exchanger 104 comprising a precooling heat exchanger section and a liquefaction heat exchanger section. The second auxiliary natural gas stream 102 is precooled in the precooling heat exchanger section of the second flash gas heat exchanger 104 to form a precooled second auxiliary natural gas stream, and the precooled second auxiliary natural gas stream is then further cooled and liquefied in the liquefaction heat exchanger section of the second flash gas heat exchanger 104 to form a third LNG stream 106.

A first side stream 119 of natural gas is withdrawn from the precooled first auxiliary natural gas stream prior to the further cooling and liquefaction of the precooled first auxiliary natural gas stream in the liquefaction heat exchanger section of the first flash gas heat exchanger 114, and a second side stream 109 of natural gas is withdrawn from the precooled second auxiliary natural gas stream prior to the further cooling and liquefaction of the precooled second auxiliary natural gas stream in the liquefaction heat exchanger section of the second flash gas heat exchanger 104. The first and second side streams 119, 109 of natural gas are introduced into and combined with the precooled natural gas feed stream 126, prior to the precooled natural gas feed stream 128 being further cooled and liquefied in the liquefaction heat exchanger section 230 of the main heat exchanger.

The first LNG stream 132 is expanded in an LNG hydraulic turbine 133 before being flashed across J-T valve 135, and the second LNG stream 116 is flashed across J-T valve 117, with the two streams being then combined and introduced into a high pressure (HP) flash drum 136 where they are separated into a liquid phase and a vapor phase. The vapor phase and liquid phases are withdrawn from the HP flash drum 136 forming, respectively, a first flash gas stream 137 and the fourth LNG stream 141.

The third LNG stream 106 and the fourth LNG stream 141 are flashed across J-T valves 107, 142 before being combined and introduced into a low pressure (LP) flash drum 144 where they are separated into a liquid phase and a vapor phase. The vapor phase and liquid phases are withdrawn from the LP flash drum 144 forming, respectively, a second flash gas stream 147 and a LNG product stream 145. The LNG product stream 145 is routed to an LNG storage tank 193 for storage.

The first flash gas stream 137 is routed to the cold side of the first flash gas heat exchanger 114 where it provides the cooling duty for precooling, cooling and liquefying the first auxiliary natural gas stream 112. The first flash gas stream 137 is warmed in the cold side of the first flash gas heat exchanger 114 to form a warmed first flash gas stream 139.

The second flash gas stream 147 is routed to the cold side of the second flash gas heat exchanger 104 where it provides the cooling duty for precooling, cooling and liquefying the second auxiliary natural gas stream 102. The second flash gas stream 147 is warmed in the cold side of the second flash gas heat exchanger 104 to form a warmed second flash gas stream 148.

The warmed first flash gas stream 139 and warmed second flash gas stream 148 are then compressed and combined in a multi-stage flash gas compressor 149 to form a compressed flash gas stream 151 that is then cooled in an aftercooler 153. Vapor accumulating in the head space of the LNG storage tank 293 is withdrawn from the LNG storage tank 193 as a boil-off gas (BOG) stream 194 that is routed from the LNG storage tank 193 to a BOG compressor 195. After compression in the BOG compressor 195, the BOG stream is cooled in a BOG aftercooler 197. The compressed flash gas stream 155 exiting aftercooler 153 is combined with the compressed BOG stream 199 exiting BOG aftercooler 197 and introduced into the natural gas feed stream 100 prior to the natural gas feed stream 122 being introduced into the main heat exchanger.

Refrigeration for the main heat exchanger is provided by a methane-based refrigerant (typically consisting of natural gas with a small amount of nitrogen) circulating in a closed-loop reverse Brayton refrigeration cycle. Briefly, the warmed gaseous refrigerant 189 exiting the cold side of the precooling section 124 of the main heat exchanger is compressed in a multi-stage refrigerant compressor comprising first 158 and second 165 compression stages with an intercooler 161 and aftercooler 168. the compressed refrigerant stream 170 exiting the aftercooler is then divided into two streams 171 and 174. Stream 171 is further compressed in the compressor portion of a warm compander 172 to form stream 173, and stream 174 is further compressed in the compressor portion of a cold compander 175 to form stream 176. Streams 173 and 176 and then recombined and cooled in an aftercooler 178 to form a further compressed refrigerant stream 179.

The further compressed refrigerant stream 179 is then divided again into two streams, namely a stream 181 consisting of a first portion of the compressed refrigerant and a stream 180 consisting of a second portion of the compressed refrigerant. Stream 181 is precooled in the precooling heat exchanger section 124 of the main heat exchanger and the resulting precooled stream 184 is then expanded in the expander portion of the cold compander 175 to form a first cold refrigerant stream 185. Stream 180 is expanded in the expander portion of the warm compander 172 to form a second cold refrigerant stream 187.

The first cold refrigerant stream 185 is routed to the cold side of the liquefaction section 130 where it is warmed to provide the cooling duty for further cooling and liquefying the precooled natural gas feed steam 128. The first cold refrigerant stream 186 exiting the liquefaction section 130 and the second cold refrigerant stream 187 are then combined and introduced into the cold side of the precooling section 124 where they are warmed to provide the cooling duty for precooling the natural gas feed steam 122 and the stream 181 consisting of the first portion of the compressed refrigerant stream. The combined first cold refrigerant stream and second cold refrigerant stream exiting the precooling section 124 then form the warmed gaseous refrigerant stream 289 that is compressed in the multi-stage refrigerant compressor 158/165, as discussed above.

Figure 2:
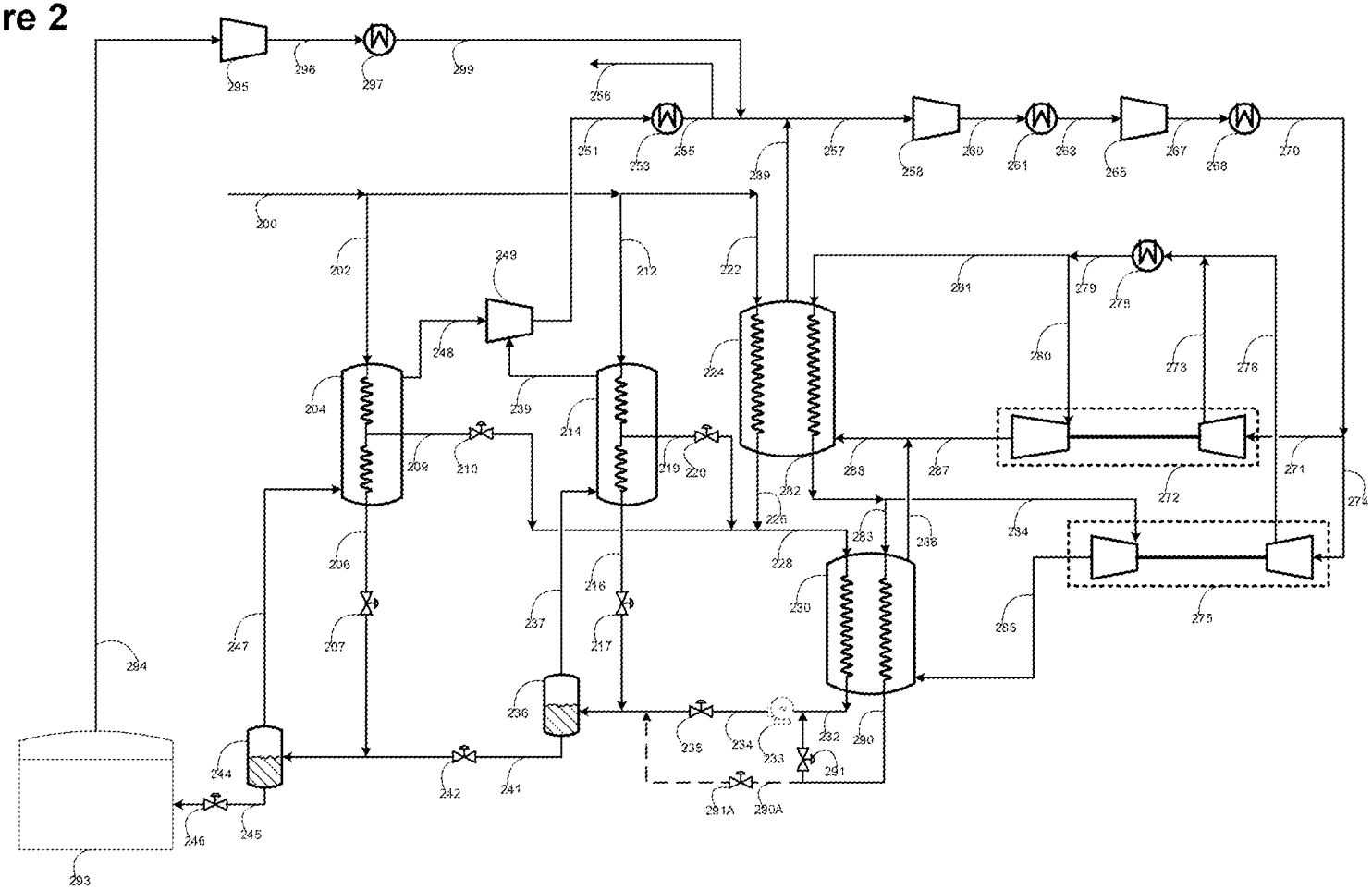
FIG. 2 is a schematic flow diagram depicting a method and system according to a first embodiment of the present invention for cooling and liquefying natural gas.

Referring to FIG. 2, a method and system for liquefying natural gas in accordance with a first embodiment of the present invention is shown.

A natural gas feed stream 200, 222 which is typically at ambient temperature and a high-pressure, typically 20 to 100 bara, is routed to a main heat exchanger comprising one or more heat exchanger sections for cooling and liquefying the natural gas feed stream 222. Preferably, the natural gas feed stream 200 is at least substantially free of natural gas liquids (C2-C5+ hydrocarbons), heavy hydrocarbons (C6+ hydrocarbons) and aromatics (e.g. benzene, toluene, ethylbenzene and xylenes). Typically, the natural gas feed stream 200 will already have been pretreated in a pretreatment section (not shown). Depending on the composition of the natural gas feed, said pretreatment may have included treating the natural gas feed stream in an acid gas removal unit for removing $H_2S$ and $CO_2$ impurities, a dehydration unit for removing water, and/or a mercury removal unit.

Two auxiliary streams of natural gas 202, 212 are withdrawn from the natural gas feed stream 200 before the natural gas feed stream 222 is introduced into the main heat exchanger. More specifically, the initial natural gas feed stream 200 is divided into three portions. A first portion, constituting between 5 and 40 percent and preferably between 15 and 30 percent of the flow of the initial natural gas feed stream 200, is withdrawn to form a first auxiliary natural gas stream 212. A second portion, constituting between 5 and 30 percent and preferably between 10 and 20 percent of the flow of the initial natural gas feed stream 200, is withdrawn to form a second auxiliary natural gas stream 202. Finally, a third (and typically major) portion, constituting the remainder of the flow of the initial natural gas feed stream 200, forms the natural gas stream 222 that is then routed to and introduced into the main heat exchanger for cooling and liquefaction.

In the illustrated embodiment, the main heat exchanger consists of two heat exchanger sections 224, 230, namely a precooling section 224 and a liquefaction section 230. In the illustrated embodiment, the precooling section 224 and liquefaction section 230 are both coil-wound heat exchanger sections housed in separate units. However, in other embodiments the two sections could be housed in a single unit (such as a coil wound heat exchanger unit in which the two sections are housed in the same shell casing), and/or could be heat exchanger sections of a different type, such as heat exchanger sections of the shell and tube or plate fin type, although coil wound heat exchanger sections are preferred. Instead of having just two heat exchanger sections, the main heat exchanger could also consist of just one heat exchanger section, or three or more heat exchanger sections arranged in series and/or in parallel. For example, in one embodiment the precooling section 224 could be split into two or more precooling sections arranged in parallel and both connecting in series to the liquefaction section 230, with the streams being warmed and cooled in the precooling sections being divided between the precooling sections before being recombined.

The natural gas feed stream 222 is precooled in the precooling heat exchanger section 224 to between −45° C. and −25° C., and more preferably between −40° C. and −30° C., via indirect heat exchange with first and third cold refrigerant streams 286, 287, that will be described in more detail below. The resulting precooled natural gas feed stream 226, 228 is then further cooled and liquefied in the liquefaction heat exchanger section 230, via indirect heat exchange with the first cold refrigerant stream 285, to form a first LNG stream 232 that is withdrawn from the liquefaction heat exchanger section 230 at a temperature of between −115° C. and −90° C. and more preferably between −110° C. and −95° C.

The first auxiliary natural gas stream 212 is routed to a first flash gas heat exchanger 214 for cooling and liquefaction, and the second auxiliary natural gas stream 202 is routed to a second flash gas heat exchanger 204 for cooling and liquefaction.

In the illustrated embodiment, the first and second flash gas heat exchangers 214 and 204 each consists of two heat exchanger sections in the form of a precooling section and a liquefaction section. In the illustrated embodiment, the precooling and liquefactions sections of the first flash gas heat exchanger 214 are coil-wound heat exchanger sections housed in a single unit (i.e. within the same shell casing), and the precooling and liquefactions sections of the second flash gas heat exchanger 204 are coil-wound heat exchanger sections housed in a single unit (i.e. within the same shell casing). However, in other embodiments the two sections of each heat exchanger could be housed in separate unit (such as in separate shell casings), and/or could be heat exchanger sections of a different type, such as heat exchanger sections of the shell and tube or plate fin type, although coil wound heat exchanger sections are preferred. Each flash gas heat exchanger could also consist of more, or fewer heat exchanger sections.

The first auxiliary natural gas stream 212 is precooled to −25° C. and −5° C. and preferably between −20° C. and −10° C. in the precooling heat exchanger section of the first flash gas heat exchanger 214 to form a precooled first auxiliary natural gas stream. The precooled first auxiliary natural gas stream is then further cooled and liquefied in the liquefaction heat exchanger section of the first flash gas heat exchanger 214 to form a second LNG stream 216 that is withdrawn from the liquefaction heat exchanger section at a temperature of between −135° C. and −115° C. and more preferably between −130° C. and −120° C. The precooling, cooling and liquefaction of the first auxiliary natural gas stream 212 in the first flash gas heat exchanger 214 is achieved via indirect heat exchange with a first flash gas stream 237 that will be described in more detail below.

The second auxiliary natural gas stream 202 is precooled to −25° C. and −5° C. and preferably between −20° C. and −10° C. in the precooling heat exchanger section of the second flash gas heat exchanger 204 to form a precooled second auxiliary natural gas stream. The precooled second auxiliary natural gas stream is then further cooled and liquefied in the liquefaction heat exchanger section of the second flash gas heat exchanger 204 to form a third LNG stream 206 that is withdrawn from the liquefaction heat exchanger section at a temperature of between −155° C. and −135° C. and more preferably between −150° C. and −140° C. The precooling, cooling and liquefaction of the second auxiliary natural gas stream 202 in the second flash gas heat exchanger 204 is achieved via indirect heat exchange with a second flash gas stream 247 that will be described in more detail below.

In the illustrated embodiment, a first side stream 219 of natural gas is withdrawn from the precooled first auxiliary natural gas stream prior to the further cooling and liquefaction of the precooled first auxiliary natural gas stream in the liquefaction heat exchanger section of the first flash gas heat exchanger 214, and a second side stream 209 of natural gas is withdrawn from the precooled second auxiliary natural gas stream prior to the further cooling and liquefaction of the precooled second auxiliary natural gas stream in the liquefaction heat exchanger section of the second flash gas heat exchanger 204. The first and second side streams 219, 209 of natural gas are introduced into and combined with the precooled natural gas feed stream 226, prior to the precooled natural gas feed stream 228 being further cooled and liquefied in the liquefaction heat exchanger section 230 of the main heat exchanger. This is done in order to better balance the cooling duties between the various heat exchanger sections. The first side stream 219 is withdrawn at a temperature of between −25° C. and −5° C. and more preferably between −20° C. and −10° C., and has a flow rate of between 10 and 50 percent and more preferably between 20 and 40 percent of the flow rate of the first auxiliary natural gas stream 212. The second side stream 209 is withdrawn at a temperature of between −25° C. and −5° C. and more preferably between −20° C. and −10° C., and has a flow rate of between 10 and 50 percent and more preferably between 20 and 40 percent of the flow rate of the second auxiliary natural gas stream 202.

The first LNG stream 232, withdrawn from the liquefaction section 230 of the main heat exchanger, the second LNG stream 216, withdrawn from liquefaction heat exchanger section of the first flash gas heat exchanger 214, and a second cold refrigerant stream 290, withdrawn from the liquefaction section 230 of the main heat exchanger and that will be described in more detail below, are combined, flashed and separated form a fourth LNG stream 241 and the first flash gas stream 237.

In the illustrated embodiment, the first LNG stream 232 is expanded in a LNG Hydraulic Turbine 233 where work is extracted by reducing pressure of the streams (thereby increasing liquefaction efficiency) before being flashed across J-T valve 235. The second cold refrigerant stream 290 is either passed through (and as necessary expanded across) flow control valve 291 and combined with the first LNG stream 232 upstream of the Hydraulic Turbine 233, or is passed through and flashed across flow control valve 291A and combined with the first LNG stream 232 downstream of J-T valve 235, depending on whether the pressure of the second cold refrigerant stream 290 is equal to or greater than the pressure of the first LNG stream 232 (in which case the steams are combined upstream of the Hydraulic Turbine 233) or less than the pressure of the first LNG stream 232 (in which case the streams are combined downstream of J-T valve 235). The second LNG stream 216 is flashed across J-T valve 217, and combined with the first LNG stream 232 and the second cold refrigerant stream 290 (downstream of J-T valve 235), with the combined streams being then introduced into a phase separator, in the form of high pressure (HP) flash drum 236, where they are separated into a liquid phase and a vapor phase. The HP flash drum 236 operates at a pressure of 20 to 5 bara. The vapor phase and liquid phases are withdrawn from the HP flash drum 236 forming, respectively, the first flash gas stream 237 and the fourth LNG stream 241.

It should be noted, however, that any suitable arrangement for combining, flashing and separating the first LNG stream 232, second LNG stream 216 and second cold refrigerant stream 290 can be used. The LNG Hydraulic Turbine 233 could be omitted. The first LNG stream 232 and the second LNG stream 216 could, if obtained at essentially the same pressure, could be combined and then flashed together. One or each of the first LNG stream 232, the second cold refrigerant stream 290 and the second LNG stream 216 could be introduced separately into the HP flash drum 236 where the streams are then combined; or one or each of the first LNG stream 232, the second cold refrigerant stream 290 and the second LNG stream 216 could be flashed and separated in their own phase separator, with the vapor phases of the phase separators being then combined to form the first flash gas stream 237 and with the liquid phases of the phase separators being then combined to form the fourth LNG stream 241.

The third LNG stream 206, withdrawn from liquefaction heat exchanger section of the second flash gas heat exchanger 204, and the fourth LNG stream 241 are then combined, flashed and separated to form a LNG product stream 245 and the second flash gas stream 247.

In the illustrated embodiment, the third LNG stream 206 and the fourth LNG stream 241 are flashed across J-T valves 207, 242 before being combined and introduced into a phase separator, in the form of low pressure (LP) flash drum 244, where they are separated into a liquid phase and a vapor phase. The LP flash drum 244 operates at a pressure of 10 to 1 bara. The vapor phase and liquid phases are withdrawn from the LP flash drum 244 forming, respectively, the second flash gas stream 247 and the LNG product stream 245.

It should be noted, however, that any suitable arrangement for combining, flashing and separating the third LNG stream 206 and the fourth LNG stream 241 can be used. For example, the third LNG stream 206 and the fourth LNG stream 241 could be introduced separately into the LP flash drum 244 where the two streams are then combined; or the third LNG stream 206 and the fourth LNG stream 241 could each be flashed separated in their own phase separator, with the vapor phases of the phase separators being then combined to form the second flash gas stream 247 and with the liquid phases of the phase separators being then combined to form the LNG product stream 245.

The first flash gas stream 237 is routed to the cold side of the first flash gas heat exchanger 214 where it provides the cooling duty for precooling, cooling and liquefying the first auxiliary natural gas stream 212, as described above. The first flash gas stream 237 is warmed in the cold side of the first flash gas heat exchanger 214 to within a few degrees centigrade of the temperature of the natural gas feed stream 200 (via indirect heat exchange with the first auxiliary natural gas stream 212 withdrawn from the natural gas feed stream 200) to form a warmed first flash gas stream 239.

The second flash gas stream 247 is routed to the cold side of the second flash gas heat exchanger 204 where it provides the cooling duty for precooling, cooling and liquefying the second auxiliary natural gas stream 202, as described above. The second flash gas stream 247 is warmed in the cold side of the second flash gas heat exchanger 204 to within a few degrees centigrade of the temperature of the natural gas feed stream 200 (via indirect heat exchange with the second auxiliary natural gas stream 202 withdrawn from the natural gas feed stream 200) to form a warmed second flash gas stream 248.

The warmed first flash gas stream 239 and warmed second flash gas stream 248 are then compressed and combined to form a compressed flash gas stream 255. In the illustrated embodiment, the warmed first and second flash gas streams 239 and 248 are combined and compressed in a multi-stage flash gas compressor 249, that may for example have intercooling (in the form of one or more intercoolers) to improve efficiency, with the warmed second flash gas stream 248 being routed to the inlet of the flash gas compressor 249 and the warmed first flash gas stream 239 being routed to an intermediate stage of the flash gas compressor 249. In this arrangement, the total head across the flash gas compressor 249 may for example be 25,000 to 40,000 meters of head. The compressed flash gas stream 251 exiting the flash gas compressor 249 is then cooled in an aftercooler 253, against for example an ambient temperature fluid such as water, to form a compressed flash gas stream 255 at for example ambient temperature. In other embodiments the multi-stage flash gas compressor 249 could for example be replaced by separate compressors, operating in series (for example in a similar manner to the multi-stage flash gas compressor) or in parallel (for example with the warmed first flash gas stream 239 and warmed second flash gas stream 248 being separately compressed and then combined).

In the illustrated embodiment, the LNG product stream 245 is routed to an LNG storage tank 293 for storage. Vapor accumulating in the head space of the LNG storage tank 293, consisting for example of tank flash, boil-off gas, and vapor displacement, is withdrawn from the LNG storage tank 293 as a boil-off gas (BOG) stream 294. The BOG stream 294 is routed from the LNG storage tank 293 to a BOG compressor 295. After compression in the BOG compressor 295, the BOG stream is cooled in a BOG aftercooler 297, against for example an ambient temperature fluid such as water, forming a compressed BOG stream 299 at for example ambient temperature. Alternatively, depending on preferred operation, the LNG Storage Tank 293 may be operated at bubble point. In this case, the BOG stream 294 and associated BOG compressor 295 and BOG aftercooler 297 may be eliminated, or the BOG stream 294 may consist only of vapor displacement with the BOG compressor 295 and BOG aftercooler 297 being sized accordingly.

The compressed flash gas stream 255 is combined with a warmed gaseous refrigerant steam 289 exiting the cold side of the precooling section 224 of the main heat exchanger and, when present, with the compressed BOG stream 299 and compressed to form a compressed refrigerant stream 270. In the illustrated embodiment, the compressed flash gas stream 255, warmed gaseous refrigerant steam 289 and compressed BOG stream 299 combined and compressed in a multi-stage refrigerant compressor with an intercooler and aftercooler. The combined stream 257 of compressed flash gas, warmed gaseous refrigerant and compressed is compressed in a first compression stage 258 of the refrigerant compressor forming refrigerant stream 260 that is then cooled in intercooler 261 (against for example an ambient temperature fluid such as water). The refrigerant stream 263 exiting intercooler 261 is then further compressed in a second compression stage 265 of the refrigerant compressor and cooled in aftercooler 268 (against for example an ambient temperature fluid such as water) forming the compressed refrigerant stream 270.

The compressed refrigerant stream 270 is then divided into two streams 271 and 274 in order to distribute the flow between the compression stages (compressor portions) of two companders 272 and 275. Stream 271, which makes up between 40 and 80 percent and more preferably between 50 and 70 percent of the flow of compressed refrigerant stream 270, is further compressed in the compressor portion of a warm compander 272 to form stream 273, and stream 274 is further compressed in the compressor portion of a cold compander 275 to form stream 276. Streams 273 and 276 and then recombined and cooled in an aftercooler 278 (against for example an ambient temperature fluid such as water) to form a further compressed refrigerant stream 279. In an alternative arrangement, streams 273 and 276 could be cooled in separate aftercoolers before being recombined.

The further compressed refrigerant stream 279 is then divided again into two streams, namely a stream 281 consisting of first and second portions of the compressed refrigerant stream (as will be further explained below) and which makes up between 40 and 80 percent and more preferably between 50 and 70 percent of the flow of the compressed refrigerant stream 279, and a stream 280 consisting of a third portion of the compressed refrigerant stream 279.

Stream 281, consisting of first and second portions of the compressed refrigerant stream, is precooled in the precooling heat exchanger section 224 of the main heat exchanger to between −45° C. and −25° C., and more preferably between −40° C. and −30° C., via indirect heat exchange with the first and third cold refrigerant streams 286, 287, the stream 281 being routed through a separate circuit (i.e. one or more passages) in the warm side of the precooling heat exchanger section 224 than the circuit (i.e. one or more passages) through which the natural gas feed stream 222 is passed and being precooled to a similar temperature as the precooled natural gas feed stream 226. The resulting precooled stream 282 is then further divided into a stream 284 consisting of the first portion of the compressed refrigerant stream and a stream 283 consisting of the second portion of the compressed refrigerant stream.

Stream 283 consisting of the second portion of the compressed refrigerant stream, and which makes up between 5 and 35 percent and more preferably between 10 and 20 percent of the flow of stream 282, is then further cooled (and liquefied) in the liquefaction heat exchanger section 230 of the main heat exchanger, via indirect heat exchange with the first cold refrigerant stream 285, to form the second cold refrigerant stream 290 that is withdrawn from the liquefaction heat exchanger section 230 at a temperature of between −115° C. and −90° C. and more preferably between −110° C. and −95° C., and is then combined, flashed and separated with the first LNG stream 232 as discussed above; the stream 283 being routed through a separate circuit in the warm side of the liquefaction heat exchanger section 230 than the circuit through which the precooled natural gas feed stream 228 is passed and being cooled to a similar temperature as the first LNG stream 232.

Stream 280, consisting of the third portion of the compressed refrigerant stream, is expanded in the expander portion of the warm compander 272 to form the third cold refrigerant stream 287 that is routed to the cold side of the precooling section 224 of the main heat exchanger where it provides (alongside the first cold refrigerant stream) cooling duty for precooling the natural gas feed steam 222 and the stream 281 consisting of the first and second portions of the compressed refrigerant stream, as described above. The third portion of the compressed refrigerant stream preferably remains gaseous as it is expanded in the expander portion of the warm compander 272 such that the third cold refrigerant stream 287 is formed as a gaseous refrigerant stream.

Stream 284 consisting of the first portion of the compressed refrigerant stream, is expanded in the expander portion of the cold compander 275 to form the first cold refrigerant stream 285 that is routed to the cold side of the liquefaction section 230 of the main heat exchanger where it provides the cooling duty for further cooling and liquefying the precooled natural gas feed steam 228 and the stream 283 consisting of the second portion of the compressed refrigerant stream, as described above. The first portion of the compressed refrigerant stream preferably remains gaseous as it is expanded in the expander portion of the cold compander 275 such that the first cold refrigerant stream 285 is formed as a gaseous refrigerant stream.

More specifically, the first cold refrigerant stream is introduced into and warmed in the cold side of the liquefaction section 230, where it is warmed via indirect heat exchange with the precooled natural gas feed steam 228 and the stream 283 consisting of the second portion of the compressed refrigerant stream. The first cold refrigerant stream 286 exiting the liquefaction section 230 (which has been warmed to within a few degrees centigrade of the temperature of the precooled natural gas feed stream 228 entering the liquefaction section 230) is then passed through the cold side of the precooling section 224 alongside the third cold refrigerant stream 287, where the first cold refrigerant stream 286 is further warmed and the third cold refrigerant stream 287 is warmed via indirect heat exchange with the natural gas feed steam 222 and the stream 281 consisting of the first and second portions of the compressed refrigerant stream. The combined first cold refrigerant stream and third cold refrigerant stream exiting the precooling section 224 (which have been warmed to within a few degrees centigrade of the temperature of the natural gas feed stream 222 entering the precooling section 224) form the warmed gaseous refrigerant stream 289 that is then combined with the compressed flash gas stream 255 and, when present, the compressed BOG stream 299, as discussed above.

In the illustrated embodiment the first cold refrigerant stream 286 exiting the liquefaction section 230 is combined with the third cold refrigerant stream 287 prior to the combined stream 288 being introduced into and warmed in the cold side of the precooling section 224. However, in alternative embodiments the first cold refrigerant stream 285 exiting the liquefaction section 230 and the third cold refrigerant stream 287 could be separately introduced into and combined in the cold side of the precooling section 224, or (in particular where the precooling section 224 is a heat exchanger section of the plate fin type) the first cold refrigerant stream 285 exiting the liquefaction section 230 and the third cold refrigerant stream 287 could be passed through and warmed in separate passages in the cold side of the precooling section 224 and then combined after being withdrawn from the precooling section 224.

The flash gas compressor 249, refrigerant compressor 258, 265 and (when present) BOG compressor 295 can be powered via any suitable means. In the illustrated embodiment, a portion of the compressed flash gas stream 255 is withdrawn as a fuel stream 256 (prior to the compressed flash gas stream 255 being combined with the warmed gaseous refrigerant stream 289 and, when present, the compressed BOG stream 299), which fuel stream can be used to power gas turbines used to drive said compressors directly and/or for the generation of electricity used to drive said compressors. Alternatively, where power is available from off-site (such as for example from an electrical grid) this may be used power the compressors, in which case there may be no need for an additional fuel and fuel stream 256 may be eliminated.

Figure 2A:
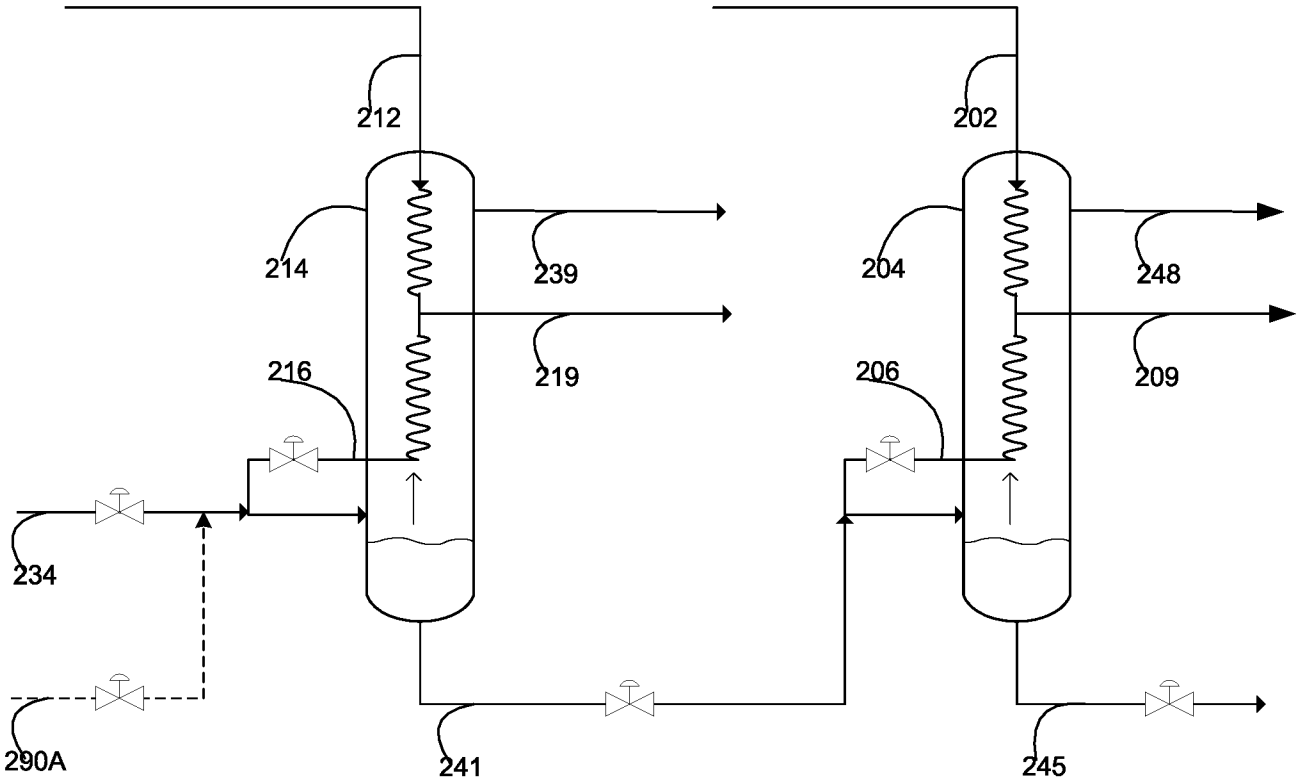
FIG. 2A is a schematic flow diagram depicting integrated heat exchangers and phase separators that can be used in the method and system of FIG. 2.

Instead of using separate flash gas heat exchangers 214/204 and phase separators 236/244 as shown in FIG. 2, it is possible to replace these with integrated heat exchangers and phase separators, as is shown in FIG. 2A.

In this arrangement, the first flash gas heat exchanger unit 214 and the second flash gas heat exchanger unit 204 are each coil-wound heat exchanger units, and each unit comprises a shell casing containing both the precooling and liquefaction sections (that are, in this case, both coil-wound heat exchanger sections) and a phase separator section that is located below the precooling and liquefaction sections.

The first LNG stream 234 exiting the LNG Hydraulic Turbine 233, the second cold refrigerant stream 290 and the second LNG stream 216 are flashed across J-T valves and combined and introduced into the phase separator section of the first flash gas heat exchanger unit 214 where they are separated into a liquid phase and a vapor phase, the liquid phase being withdrawn from the bottom of the first flash gas heat exchanger unit 214 to form the fourth LNG stream 241, and the vapor phase forming the first flash gas stream that rises through the shell side of the liquefaction and precooling sections of the first flash gas heat exchanger unit 214 providing the cooling duty for precooling, cooling and liquefying the first auxiliary natural gas stream 212.

The third LNG stream 206 and the fourth LNG stream 241 are flashed across J-T valves and combined and introduced into the phase separator section of the second flash gas heat exchanger unit 204 where they are separated into a liquid phase and a vapor phase, the liquid phase being withdrawn from the bottom of the second flash gas heat exchanger unit 204 to form the LNG product stream 245, and the vapor phase forming the second flash gas stream that rises through the shell side of the liquefaction and precooling sections of the second flash gas heat exchanger unit 204 providing the cooling duty for precooling, cooling and liquefying the second auxiliary natural gas stream 202.

Compared to the closed-loop method and system depicted in FIG. 1 and likewise the closed-loop AP-C1™ method and system described in the prior art, the "semi-open" loop method and system of FIG. 2 provides for improved operability and reduced equipment complexity. In particular, the in method and system of FIG. 2 the outlet of the flash gas compressor 249 is routed to the inlet of the refrigerant compressor 258/265 instead of connecting to the natural gas feed stream (which for liquefaction efficiency needs to be at a relatively high pressure). This shifts refrigeration power from the flash gas compressor to the refrigerant compressor, allowing the flash gas compressor to be significantly simplified by allowing the reduction of the number of compression stages. For example, in comparison to a closed-loop AP-C1™ method and system requiring a five-stage flash gas compressor, the method of FIG. 2 might only require a three-stage compressor, which would also result in one less compressor casing.

Compared to the open-loop method and system described and depicted in US 2018/0180354 A1 the "semi-open" loop method and system of FIG. 2 can operate more efficiently, especially during turndown. In particular, in the method and system of US 2018/0180354 A1 a portion of the refrigerant exiting the refrigerant compressor is routed directly to the natural gas feed, and thus the refrigerant compressor must be operated such that the outlet pressure of the refrigerant compressor matches natural gas feed pressure (which, as noted above, needs to be at a relatively high pressure for liquefaction efficiency). Conversely, in the method and system of FIG. 2 the compressed refrigerant is kept separate from and is not combined with the natural gas feed stream, thereby decoupling the outlet pressure of the refrigerant compressor from the natural gas feed pressure. This, in turn, allows the pressure of the refrigerant in the refrigerant loop to be turned-down, while continuing to operate the natural gas feed stream at a higher, a more efficient pressure for liquefaction, thus provides more degrees of freedom and allowing a greater level of optimization of the process under different operating conditions.

Example 1

In this example, a method and system for cooling and liquefying natural gas as depicted in FIG. 2 was simulated, using Aspen simulation software, version 10, available from Aspen Technologies, Inc.

Table 1 shows the data from the simulated example. In this example, the two-stage refrigerant compressor 258/265 had an approximate gas horsepower of 124.6 MW; the multi-stage flash gas compressor 249 (which in this example included 2 intercoolers) and BOG compressor 295 had an approximate gas horsepower of 14.0 MW and 5.0 MW, respectively; and the second cold refrigerant stream 290 was combined with the first LNG stream 232 upstream of the Hydraulic Turbine 233.

TABLE 1

| Stream # | | 200 | 202 | 206 | 209 | 212 | 216 |
|---|---|---|---|---|---|---|---|
| Temperature | ° C. | 40.0 | 40.0 | −143.0 | −15.4 | 40.0 | −123.7 |
| Pressure | bara | 86.0 | 86.0 | 84.5 | 85.2 | 86.0 | 82.5 |
| Vapor Fraction | — | 1.00 | 1.00 | 0.00 | 1.00 | 1.00 | 0.00 |
| Flow | kgmol/hr | 24,563 | 3,034 | 2,045 | 990 | 4,642 | 3,114 |
| Composition | mol % | | | | | | |
| N2 | | 1.50 | 1.50 | 1.50 | 1.50 | 1.50 | 1.50 |
| C1 | | 92.40 | 92.40 | 92.40 | 92.40 | 92.40 | 92.40 |
| C2 | | 3.50 | 3.50 | 3.50 | 3.50 | 3.50 | 3.50 |
| C3 | | 1.50 | 1.50 | 1.50 | 1.50 | 1.50 | 1.50 |
| I4 | | 0.50 | 0.50 | 0.50 | 0.50 | 0.50 | 0.50 |
| C4 | | 0.50 | 0.50 | 0.50 | 0.50 | 0.50 | 0.50 |
| I5 | | 0.10 | 0.10 | 0.10 | 0.10 | 0.10 | 0.10 |
| CD | | 0.01 | 0.01 | 0.01 | 0.01 | 0.01 | 0.01 |
| Total | | 100.00 | 100.00 | 100.00 | 100.00 | 100.00 | 100.00 |
| Stream # | | 219 | 222 | 226 | 228 | 232 | 234 |
| Temperature | ° C. | −16.7 | 40.0 | −36.2 | −34.4 | −103.7 | −106.7 |
| Pressure | bara | 84.9 | 86.0 | 82.5 | 82.2 | 79.4 | 29.2 |
| Vapor Fraction | — | 1.00 | 1.00 | 1.00 | 1.00 | 0.00 | 0.00 |
| Flow | kgmol/hr | 1,528 | 16,886 | 16,886 | 19,404 | 19,404 | 33,089 |
| Composition | mol % | | | | | | |
| N2 | | 1.50 | 1.50 | 1.50 | 1.50 | 1.50 | 6.78 |
| C1 | | 92.40 | 92.40 | 92.40 | 92.40 | 92.40 | 89.63 |
| C2 | | 3.50 | 3.50 | 3.50 | 3.50 | 3.50 | 2.07 |
| C3 | | 1.50 | 1.50 | 1.50 | 1.50 | 1.50 | 0.88 |
| I4 | | 0.50 | 0.50 | 0.50 | 0.50 | 0.50 | 0.29 |
| C4 | | 0.50 | 0.50 | 0.50 | 0.50 | 0.50 | 0.29 |
| I5 | | 0.10 | 0.10 | 0.10 | 0.10 | 0.10 | 0.06 |
| CD | | 0.01 | 0.01 | 0.01 | 0.01 | 0.01 | 0.00 |
| Total | | 100.00 | 100.00 | 100.00 | 100.00 | 100.00 | 100.00 |
| Stream # | | 237 | 239 | 241 | 245 | 247 | 248 |
| Temperature | ° C. | −125.5 | 34.4 | −125.5 | −144.8 | −144.8 | 34.4 |
| Pressure | bara | 11.1 | 10.6 | 11.1 | 3.6 | 3.6 | 3.0 |
| Vapor Fraction | — | 1.00 | 1.00 | 0.00 | 0.00 | 1.00 | 1.00 |
| Flow | kgmol/hr | 7,396 | 7,396 | 28,807 | 25,972 | 4,879 | 4,879 |
| Composition | mol % | | | | | | |
| N2 | | 19.28 | 19.28 | 3.00 | 1.00 | 13.00 | 13.00 |
| C1 | | 80.66 | 80.66 | 92.23 | 93.23 | 86.98 | 86.98 |
| C2 | | 0.06 | 0.06 | 2.74 | 3.31 | 0.02 | 0.02 |
| C3 | | 0.00 | 0.00 | 1.17 | 1.42 | 0.00 | 0.00 |
| I4 | | 0.00 | 0.00 | 0.39 | 0.47 | 0.00 | 0.00 |
| C4 | | 0.00 | 0.00 | 0.39 | 0.47 | 0.00 | 0.00 |
| I5 | | 0.00 | 0.00 | 0.08 | 0.09 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |
| Stream # | | 251 | 255 | 256 | 257 | 260 | 263 |
| Temperature | ° C. | 99.7 | 40.0 | 40.0 | 35.6 | 89.3 | 40.0 |
| Pressure | bara | 20.1 | 19.5 | 19.5 | 19.5 | 35.2 | 34.6 |
| Vapor Fraction | — | 1.00 | 1.00 | 1.00 | 1.00 | 1.00 | 1.00 |
| Flow | kgmol/hr | 12,275 | 12,275 | 1,903 | 149,098 | 149,098 | 149,098 |
| Composition | mol % | | | | | | |
| N2 | | 16.79 | 16.79 | 16.79 | 14.26 | 14.26 | 14.26 |
| C1 | | 83.17 | 83.17 | 83.17 | 85.70 | 85.70 | 85.70 |
| C2 | | 0.04 | 0.04 | 0.04 | 0.03 | 0.03 | 0.03 |
| C3 | | 0.00 | 0.00 | 0.00 | 0.00 | 0.00 | 0.00 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

TABLE 1-continued

| Stream # | | 267 | 270 | 271 | 273 | 274 | 276 |
|---|---|---|---|---|---|---|---|
| Temperature | ° C. | 74.7 | 40.0 | 40.0 | 88.8 | 40.0 | 90.1 |
| Pressure | bara | 50.7 | 50.1 | 50.1 | 83.3 | 50.1 | 83.3 |
| Vapor Fraction | — | 1.00 | 1.00 | 1.00 | 1.00 | 1.00 | 1.00 |
| Flow | kgmol/hr | 149,098 | 149,098 | 87,668 | 87,668 | 61,430 | 61,430 |
| Composition | mol % | | | | | | |
| N2 | | 14.26 | 14.26 | 14.26 | 14.26 | 14.26 | 14.26 |
| C1 | | 85.70 | 85.70 | 85.70 | 85.70 | 85.70 | 85.70 |
| C2 | | 0.03 | 0.03 | 0.03 | 0.03 | 0.03 | 0.03 |
| C3 | | 0.00 | 0.00 | 0.00 | 0.00 | 0.00 | 0.00 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| Stream # | | 279 | 280 | 281 | 282 | 283 | 284 |
|---|---|---|---|---|---|---|---|
| Temperature | ° C. | 40.0 | 40.0 | 40.0 | −35.4 | −35.4 | −35.4 |
| Pressure | bara | 82.7 | 82.7 | 82.6 | 80.6 | 80.6 | 80.6 |
| Vapor Fraction | — | 1.00 | 1.00 | 1.00 | 1.00 | 1.00 | 1.00 |
| Flow | kgmol/hr | 149,098 | 60,056 | 89,042 | 89,042 | 13,685 | 75,357 |
| Composition | mol % | | | | | | |
| N2 | | 14.26 | 14.26 | 14.26 | 14.26 | 14.26 | 14.26 |
| C1 | | 85.70 | 85.70 | 85.70 | 85.70 | 85.70 | 85.70 |
| C2 | | 0.03 | 0.03 | 0.03 | 0.03 | 0.03 | 0.03 |
| C3 | | 0.00 | 0.00 | 0.00 | 0.00 | 0.00 | 0.00 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| Stream # | | 285 | 286 | 287 | 288 | 289 | 290 |
|---|---|---|---|---|---|---|---|
| Temperature | ° C. | −105.9 | −37.1 | −49.2 | −42.6 | 35.2 | −103.7 |
| Pressure | bara | 21.0 | 20.3 | 20.1 | 20.1 | 19.6 | 77.8 |
| Vapor Fraction | — | 1.00 | 1.00 | 1.00 | 1.00 | 1.00 | 0.00 |
| Flow | kgmol/hr | 75,357 | 75,357 | 60,056 | 135,413 | 135,413 | 13,685 |
| Composition | mol % | | | | | | |
| N2 | | 14.26 | 14.26 | 14.26 | 14.26 | 14.26 | 14.26 |
| C1 | | 85.70 | 85.70 | 85.70 | 85.70 | 85.70 | 85.70 |
| C2 | | 0.03 | 0.03 | 0.03 | 0.03 | 0.03 | 0.03 |
| C3 | | 0.00 | 0.00 | 0.00 | 0.00 | 0.00 | 0.00 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| Stream # | | 294 | 296 | 299 |
|---|---|---|---|---|
| Temperature | ° C. | −161.1 | 10.3 | 40.0 |
| Pressure | bara | 1.1 | 20.1 | 19.5 |
| Vapor Fraction | — | 1.00 | 1.00 | 1.00 |
| Flow | kgmol/hr | 3,313 | 3,313 | 3,313 |
| Composition | mol % | | | |
| N2 | | 6.35 | 6.35 | 6.35 |
| C1 | | 93.64 | 93.64 | 93.64 |
| C2 | | 0.01 | 0.01 | 0.01 |
| C3 | | 0.00 | 0.00 | 0.00 |
| I4 | | 0.00 | 0.00 | 0.00 |
| C4 | | 0.00 | 0.00 | 0.00 |
| I5 | | 0.00 | 0.00 | 0.00 |
| CD | | 0.00 | 0.00 | 0.00 |
| Total | | 100.00 | 100.00 | 100.00 |

It will be appreciated that the invention is not restricted to the details described above with reference to the preferred embodiments but that numerous modifications and variations can be made without departing from the spirit or scope of the invention as defined in the following claims.

The invention claimed is:

1. A method of liquefying natural gas, the method comprising the steps of:

(a) cooling and liquefying a natural gas feed stream via indirect heat exchange with at least a first cold refrigerant stream to form a first liquefied natural gas stream and a warmed gaseous refrigerant stream;

(b) flashing and separating the first liquefied natural gas stream to form a liquefied natural gas product stream and at least a first flash gas stream;

(c) combining and compressing the first flash gas stream and the warmed gaseous refrigerant stream to form a compressed refrigerant stream; and (d) expanding at least a first portion of the compressed refrigerant stream to form the first cold refrigerant stream;

wherein the natural gas feed stream is kept separate from and is not combined with either the first flash gas stream or the compressed refrigerant stream, and wherein step (b) comprises combining the first liquefied natural gas stream and a second cold refrigerant stream.

2. The method of claim 1, wherein step (a) takes place in one or more coil-wound heat exchanger sections of a main coil-wound heat exchanger unit or set of units.

3. The method of claim 1, wherein step (c) comprises compressing the first flash gas stream in one or more flash gas compression stages prior to combining the first flash gas stream and the warmed gaseous refrigerant stream and compressing said combined first flash gas stream and warmed gaseous refrigerant stream in one or more refrigerant compression stages to form the compressed refrigerant stream.

4. The method of claim 1, wherein the method further comprises the steps of:

(e) withdrawing a first auxiliary stream of natural gas from the natural gas feed stream prior to the natural gas feed stream being cooled and liquefied in step (a); and (f) cooling and liquefying the first auxiliary natural gas stream via indirect heat exchange with the first flash gas stream to form a second liquefied natural gas stream;

wherein the first flash gas stream is warmed in step (f) before being compressed and combined with the warmed gaseous refrigerant stream in step (c), and wherein step (b) comprises combining, flashing and separating the second liquefied natural gas stream and the first liquefied natural gas stream to form the liquefied natural gas product stream and at least the first flash gas stream.

5. The method of claim 4, wherein step (f) takes place in one or more coil-wound heat exchanger sections of a first flash gas heat exchanger unit or set of units, and wherein the first flash gas heat exchanger unit is an integrated heat exchanger and phase separator comprising a shell casing containing one or more coil-wound heat exchanger sections located above a phase separator section, and wherein said phase separator section is used in step (b) to separate the first flash gas stream from the first and second liquefied natural gas streams.

6. The method of claim 4, wherein step (f) comprises precooling, cooling and liquefying the first auxiliary natural gas stream via indirect heat exchange with the first flash gas stream to form a second liquefied natural gas stream, and wherein the method further comprises withdrawing a first side-stream of natural gas from the first auxiliary natural gas stream after precooling and prior to liquefaction of the first auxiliary natural gas stream, and introducing the first side-stream of natural gas into the natural gas feed stream after precooling of the natural gas feed stream and prior to liquefaction of the natural gas feed stream in step (a).

7. The method of claim 1, wherein step (b) comprises flashing and separating the first liquefied natural gas stream to form the liquefied natural gas product stream and at least the first flash gas stream and a second flash gas stream, wherein step (c) comprises combining and compressing the second flash gas stream, the first flash gas stream and the warmed gaseous refrigerant stream to form a compressed refrigerant stream, and wherein the natural gas feed stream is also kept separate from and is not combined with the second flash gas stream.

8. The method of claim 7, wherein step (c) comprises compressing the second flash gas stream in one or more flash gas compression stages prior to combining the second flash gas stream and the first flash gas stream and then compressing the combined first and second flash gas streams in one or more further flash gas compression stages prior to combining the combined first and second flash gas streams and the warmed gaseous refrigerant stream and compressing the combined first and second flash gas streams and the warmed gaseous refrigerant stream in one or more refrigerant compression stages to form the compressed refrigerant stream.

9. The method of claim 7, wherein the method further comprises the steps of:

(e) withdrawing a first auxiliary stream of natural gas and a second auxiliary stream of natural gas from the natural gas feed stream prior to the natural gas feed stream being cooled and liquefied in step (a);

(f) cooling and liquefying the first auxiliary natural gas stream via indirect heat exchange with the first flash gas stream to form a second liquefied natural gas stream; and (g) cooling and liquefying the second auxiliary natural gas stream via indirect heat exchange with the second flash gas stream to form a third liquefied natural gas stream wherein the first flash gas stream is warmed in step (f) before being compressed and combined with the second flash gas stream and warmed gaseous refrigerant stream in step (c), wherein the second flash gas stream is warmed in step (g) before being compressed and combined with the first flash gas stream and warmed gaseous refrigerant stream in step (c), and wherein step (b) comprises combining, flashing and separating the second liquefied natural gas stream and the first liquefied natural gas stream to form a fourth liquefied natural gas stream and the first flash gas stream, and then combining, flashing and separating the fourth liquefied natural gas stream and the third liquefied natural gas stream to form the liquefied natural gas product stream and at least the second flash gas stream.

10. The method of claim 9, wherein step (f) takes place in one or more coil-wound heat exchanger sections of a first flash gas heat exchanger unit or set of units, and step (g) takes place in one or more coil-wound heat exchanger sections of a second flash gas heat exchanger unit or set of units, wherein the first flash gas heat exchanger unit is an integrated heat exchanger and phase separator comprising a shell casing containing one or more coil-wound heat exchanger sections located above a phase separator section, wherein said phase separator section is used in step (b) to separate the first flash gas stream from the first and second liquefied natural gas streams, and wherein the second flash gas heat exchanger unit is an integrated heat exchanger and phase separator comprising a shell casing containing one or more coil-wound heat exchanger sections located above a phase separator section, wherein said phase separator section is used in step (b) to separate the second flash gas stream from the third and fourth liquefied natural gas stream.

11. The method of claim 9, wherein step (f) comprises precooling, cooling and liquefying the first auxiliary natural gas stream via indirect heat exchange with the first flash gas stream to form a second liquefied natural gas stream, wherein step (g) comprises precooling, cooling and liquefying the second auxiliary natural gas stream via indirect heat exchange with the second flash gas stream to form a third liquefied natural gas stream, and wherein the method further comprises withdrawing a first side-stream of natural gas from the first auxiliary natural gas stream after precooling and prior to liquefaction of the first auxiliary natural gas stream, withdrawing a second side-stream of natural gas from the second auxiliary natural gas stream after precooling and prior to liquefaction of the second auxiliary natural gas stream, and introducing the first side-stream of natural gas and the second side-stream of natural gas into the natural gas feed stream after precooling of the natural gas feed stream and prior to liquefaction of the natural gas feed stream in step (a).

12. The method of claim 1, wherein the method further comprises the steps of:

(h) introducing the liquefied natural gas product stream into and storing the liquefied natural gas product in a liquefied natural gas storage tank; and (i) withdrawing a boil-off gas stream from the liquefied natural gas storage tank;

wherein step (c) comprises combining and compressing the boil-off gas stream, the first flash gas stream and the warmed gaseous refrigerant stream to form the compressed refrigerant stream, wherein the natural gas feed stream is also kept separate from and is not combined with the boil-off gas stream, and wherein step (c) comprises compressing the boil-off gas stream in one or more boil-off gas compression stages prior to combining the boil-off gas stream, the first flash gas stream and the warmed gaseous refrigerant stream and compressing said combined boil-off gas stream, first flash gas stream and warmed gaseous refrigerant stream in one or more refrigerant compression stages to form the compressed refrigerant stream.

13. The method of claim 1, wherein step (d) comprises expanding a first portion of the compressed refrigerant stream to form the first cold refrigerant stream, wherein step (b) comprises combining, flashing and separating the first liquefied natural gas stream and the second cold refrigerant stream to form the liquefied natural gas product stream and at least the first flash gas stream, and wherein the method further comprises the step of:

(j) cooling a second portion of the compressed refrigerant stream, via indirect heat exchange with the first cold refrigerant stream, to form the second cold refrigerant stream.

14. The method of claim 13, wherein the method further comprises the step of:

(k) expanding a third portion of the compressed refrigerant stream to form a third cold refrigerant stream; and wherein step (a) comprises precooling the natural gas feed stream via indirect heat exchange with the first and third cold refrigerant streams and further cooling and liquefying a natural gas feed stream via indirect heat exchange with the first cold refrigerant stream to form the first liquefied natural gas stream from the natural gas feed stream and the warmed gaseous refrigerant stream from the first and third cold refrigerant streams.

15. The method of claim 14, wherein the method further comprises the step of:

(l) precooling the first and second portions of the compressed refrigerant stream via indirect heat exchange with the first and third cold refrigerant streams prior to the first portion of the compressed refrigerant stream being expanded in step (d) and prior to the second portion of the compressed refrigerant being stream being further cooled in step (j).

16. The method of claim 1, wherein the first cold refrigerant stream is a gaseous refrigerant stream.

17. A system for liquefying natural gas according to the method of claim 1, the system comprising:

one or more heat exchanger sections arranged and configured to receive a natural gas fee stream and at least a first cold refrigerant steam and to cool and liquefy the natural gas feed stream via indirect heat exchange with at least the first cold refrigerant stream to form a first liquefied natural gas stream and a warmed gaseous refrigerant stream;

one or more expansion and separation devices arranged and configured to receive, flash and separate the first liquefied natural gas stream to form a liquefied natural gas product stream and at least a first flash gas stream;

one or more conduits and refrigerant compression stages arranged and configured to receive, combine and compress the first flash gas stream and the warmed gaseous refrigerant stream to form a compressed refrigerant stream; and an expansion device arranged and configured to receive and expand at least a first portion of the compressed refrigerant stream to form the first cold refrigerant stream;

wherein the system is arranged and configured such that the natural gas feed stream is kept separate from and is not combined with either the first flash gas stream or the compressed refrigerant stream.

18. The method of claim 1, further comprising forming the second cold refrigerant stream from a portion of the compressed refrigerant stream.

19. A method of liquefying natural gas, the method comprising the steps of:

(a) cooling and liquefying a natural gas feed stream via indirect heat exchange with at least a first cold refrigerant stream to form a first liquefied natural gas stream and a warmed gaseous refrigerant stream;

(b) flashing and separating the first liquefied natural gas stream to form a liquefied natural gas product stream and at least a first flash gas stream;

(c) combining and compressing the first flash gas stream and the warmed gaseous refrigerant stream to form a compressed refrigerant stream; and (d) expanding at least a first portion of the compressed refrigerant stream to form the first cold refrigerant stream;

wherein the natural gas feed stream is kept separate from and is not combined with either the first flash gas stream or the compressed refrigerant stream, and wherein step (b) comprises combining, flashing and separating the first liquefied natural gas stream and a second cold refrigerant stream to form the liquefied natural gas product stream and at least the first flash gas stream.

* * * * *